US012215686B2

(12) United States Patent
Moon et al.

(10) Patent No.: US 12,215,686 B2
(45) Date of Patent: Feb. 4, 2025

(54) SCROLL COMPRESSOR

(71) Applicant: LG ELECTRONICS INC., Seoul (KR)

(72) Inventors: Seokhwan Moon, Seoul (KR); Sanghun Seong, Seoul (KR); Jinyong Jang, Seoul (KR); Sooho Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/381,323

(22) Filed: Oct. 18, 2023

(65) Prior Publication Data

US 2024/0151228 A1 May 9, 2024

(30) Foreign Application Priority Data

Nov. 4, 2022 (KR) ..... 10-2022-0146161

(51) Int. Cl.
*F04C 15/00* (2006.01)
*F04C 18/02* (2006.01)
*F04C 29/12* (2006.01)

(52) U.S. Cl.
CPC ..... *F04C 18/0215* (2013.01); *F04C 15/003* (2013.01); *F04C 29/12* (2013.01); *F04C 2240/30* (2013.01)

(58) Field of Classification Search
CPC ..... F04C 18/0215; F04C 18/0246; F04C 18/0269; F04C 15/003
See application file for complete search history.

(56) References Cited

U.S. PATENT DOCUMENTS 5,591,022 A * 1/1997 Protos ..... F01C 17/00 418/55.3

FOREIGN PATENT DOCUMENTS

| | | |
|---|---|---|
| JP | 06-10857 | 1/1994 |
| JP | 07-269473 | 10/1995 |
| KR | 10-2015-0126499 | 11/2015 |

OTHER PUBLICATIONS

Korean Office Action issued in Application No. 10-2022-0146161 dated Mar. 12, 2024.

* cited by examiner

*Primary Examiner* — Deming Wan
(74) *Attorney, Agent, or Firm* — KED & ASSOCIATES

(57) ABSTRACT

A scroll compressor is provided that may have a first sealing portion defined between an inner surface of an orbiting wrap and an outer surface of a non-orbiting wrap facing the inner surface of the orbiting wrap in a radial direction, and a second sealing portion defined between an inner surface of the non-orbiting wrap and an outer surface of the orbiting wrap facing the inner surface of the non-orbiting wrap in the radial direction. Further, sealing surfaces where the wraps facing each other are in surface-contact with each other may be formed on at least one of the first sealing portion or the second sealing portion. This may enlarge a sealing area between side surfaces of the wraps facing each other to suppress or prevent leakage of refrigerant suctioned in a compression chamber, thereby improving indicated efficiency and volumetric efficiency.

16 Claims, 9 Drawing Sheets

SCROLL COMPRESSOR

CROSS-REFERENCE TO RELATED APPLICATION(S)

Pursuant to 35 U.S.C. § 119(a), this application claims the benefit of the earlier filing date and the right of priority to Korean Patent Applications No. 10-2022-0146161, filed in Korea on Nov. 4, 2022, the contents of which are incorporated by reference herein in their entirety.

BACKGROUND

1. Field

A scroll compressor is disclosed herein.

2. Background

A scroll compressor is configured such that an orbiting scroll and a non-orbiting scroll are engaged with each other and a pair of compression chambers is formed while the orbiting scroll performs an orbiting motion with respect to the non-orbiting scroll. A compression chamber includes a suction pressure chamber that is formed at an outer side and into which a refrigerant is introduced, an intermediate pressure chamber in which the refrigerant is compressed as a volume thereof continuously decreases from the suction pressure chamber toward a center, and a discharge pressure chamber connected to a center of the intermediate pressure chamber such that the compressed refrigerant is discharged. Accordingly, the suction pressure chamber communicates with a suction port, the intermediate pressure chamber is sealed, and the discharge pressure chamber communicates with a discharge port.

Scroll compressors may be classified into a high-pressure scroll compressor and a low-pressure scroll compressor according to a refrigerant suction path. In the high-pressure scroll compressor, a refrigerant suction pipe is directly connected to a suction pressure chamber, so that refrigerant is directly guided to the suction pressure chamber without passing through an inner space of a casing. In the low-pressure scroll compressor, an inner space of a casing is divided into a low-pressure part or portion and a high-pressure part or portion by a high/low pressure separation plate or a discharge plenum that communicates with a refrigerant discharge port. A refrigerant suction pipe is connected to the low-pressure part such that a refrigerant of low temperature is guided into the suction pressure chamber via the inner space of the casing. Korean Patent Publication No. 10-2015-0126499 (hereinafter, "Patent Document 1"), which is hereby incorporated by reference, discloses a low-pressure scroll compressor.

In the low-pressure scroll compressor disclosed in Patent Document 1, as a suction pressure which is a low pressure is formed in the inner space of the casing, refrigerant in a compression chamber may be leaked into the inner space of the casing. More particularly, in the related art scroll compressor including Patent Document 1, a non-orbiting wrap and an orbiting wrap constituting a compression unit are brought into line-contact with each other, which may cause the refrigerant in the compression chamber to leak in a tangential direction toward a suction port that is opposite to a compression-proceeding direction, thereby deteriorating indicated efficiency and volumetric efficiency of the compressor.

BRIEF DESCRIPTION OF THE DRAWINGS

Embodiments will be described in detail with reference to the following drawings in which like reference numerals refer to like elements, and wherein.

DETAILED DESCRIPTION

Description will now be given of a scroll compressor according to exemplary embodiments disclosed herein, with reference to the accompanying drawings. As described above, scroll compressors may be classified into a high-pressure scroll compressor and a low-pressure scroll compressor according to a refrigerant suction path. Hereinafter, a low-pressure scroll compressor equipped with a high/low pressure separation plate will be described as an example.

In addition, scroll compressors may be classified into a vertical scroll compressor in which a rotary shaft is disposed perpendicular to the ground and a horizontal scroll compressor in which a rotary shaft is disposed parallel to the ground. Hereinafter, a vertical scroll compressor will be described as an example. Therefore, hereinafter, an upper side may be defined as an opposite side to the ground, and a lower side may be defined as a side facing the ground.

Scroll compressors may also be classified into a symmetrical type and an asymmetrical type according to suction positions of both compression chambers. In the symmetrical type, both compression chambers have suction positions that are symmetrically disposed at a phase difference of about 180° therebetween such that refrigerant is suctioned simultaneously into both the compression chambers. On the other hand, in the asymmetrical type, both compression chambers have the same suction position so that refrigerant is suctioned alternately into both the compression chambers. Hereinafter, a symmetrical scroll compressor will be described as an example. However, embodiments may be equally applied to an asymmetrical scroll compressor.

Figure 1:
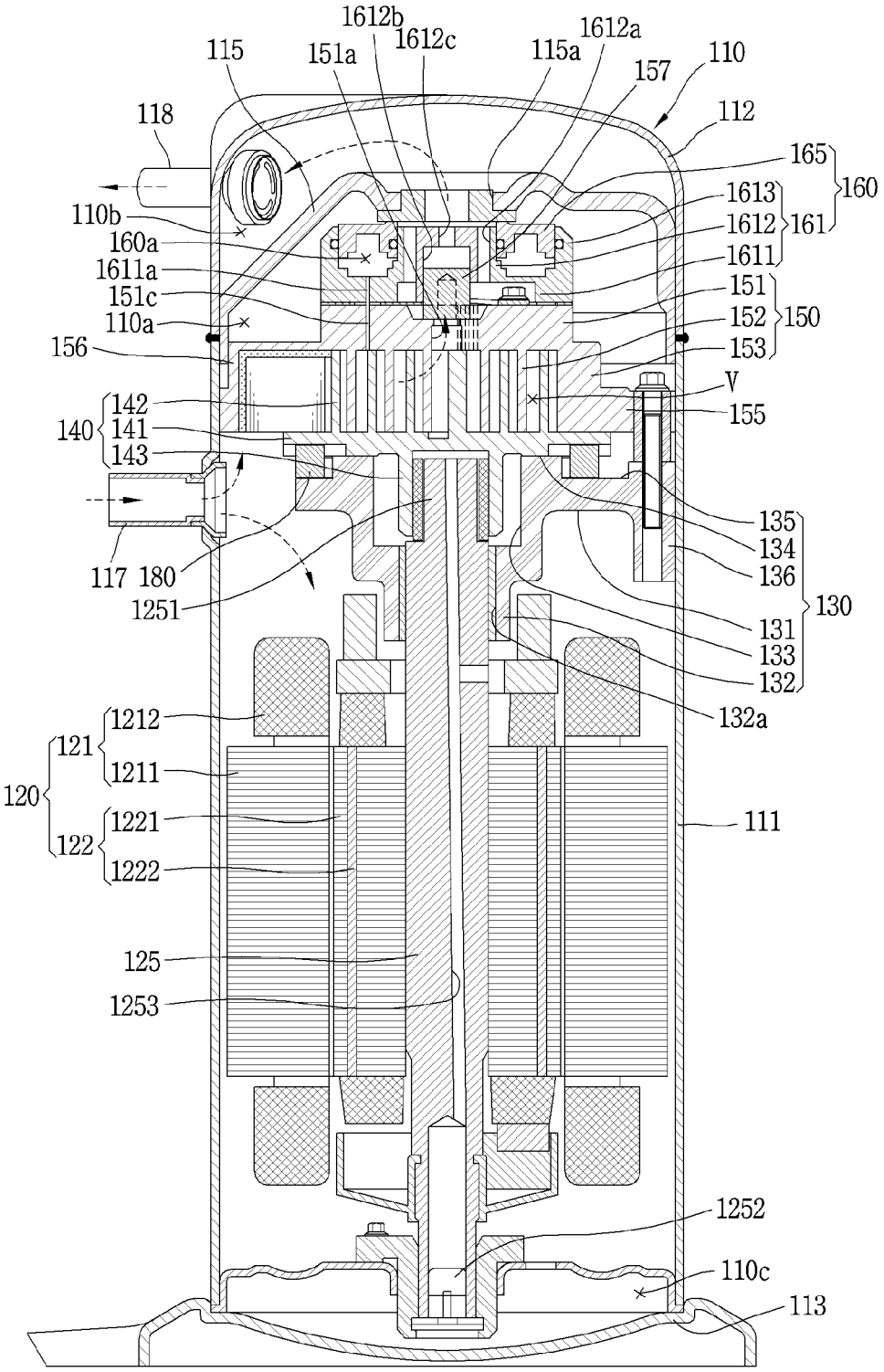
FIG. 1 is a longitudinal cross-sectional view illustrating an inner structure of a scroll compressor in accordance with an embodiment.
Figure 2:
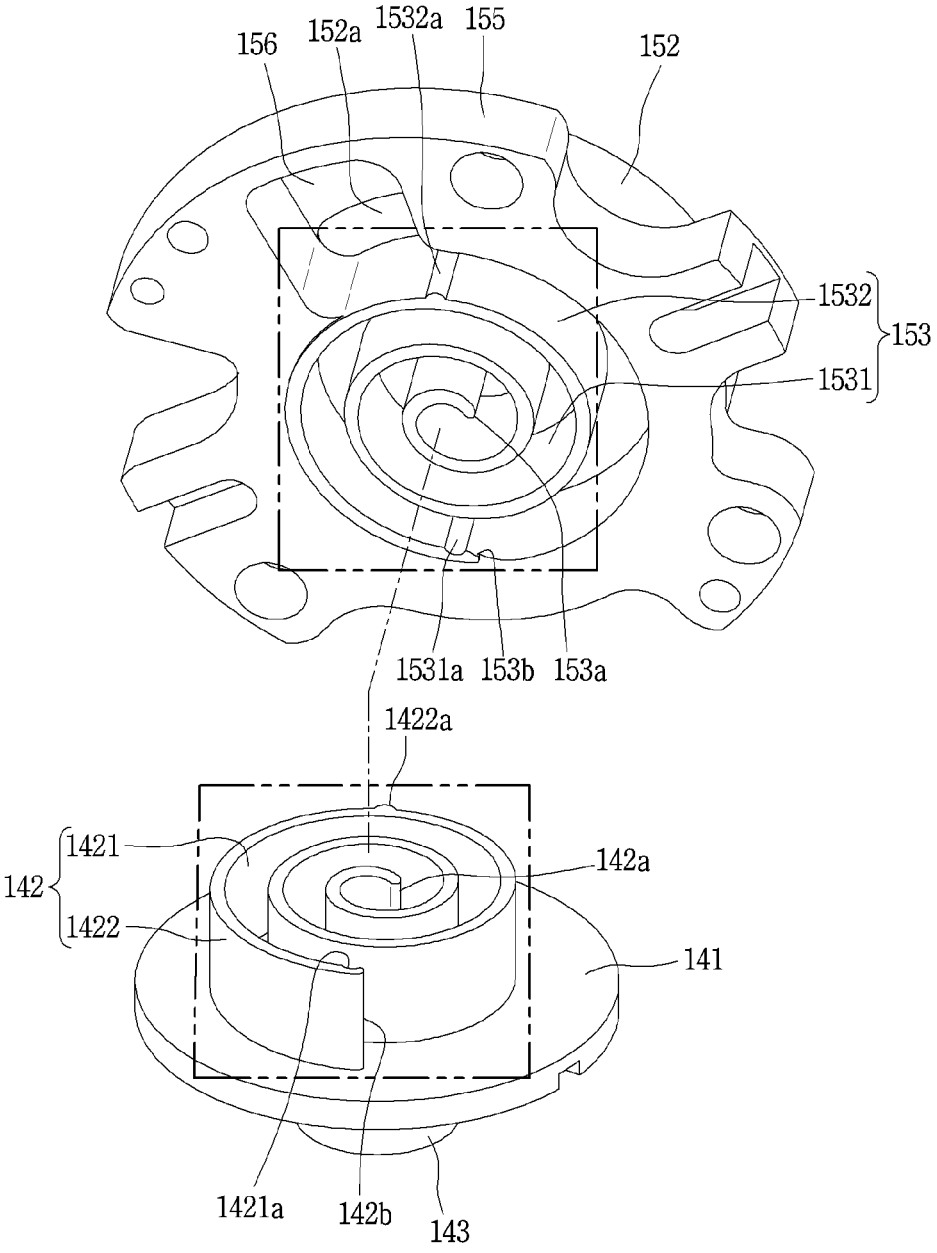
FIG. 2 is an enlarged perspective view illustrating a compression unit in FIG. 1.
Figure 3:
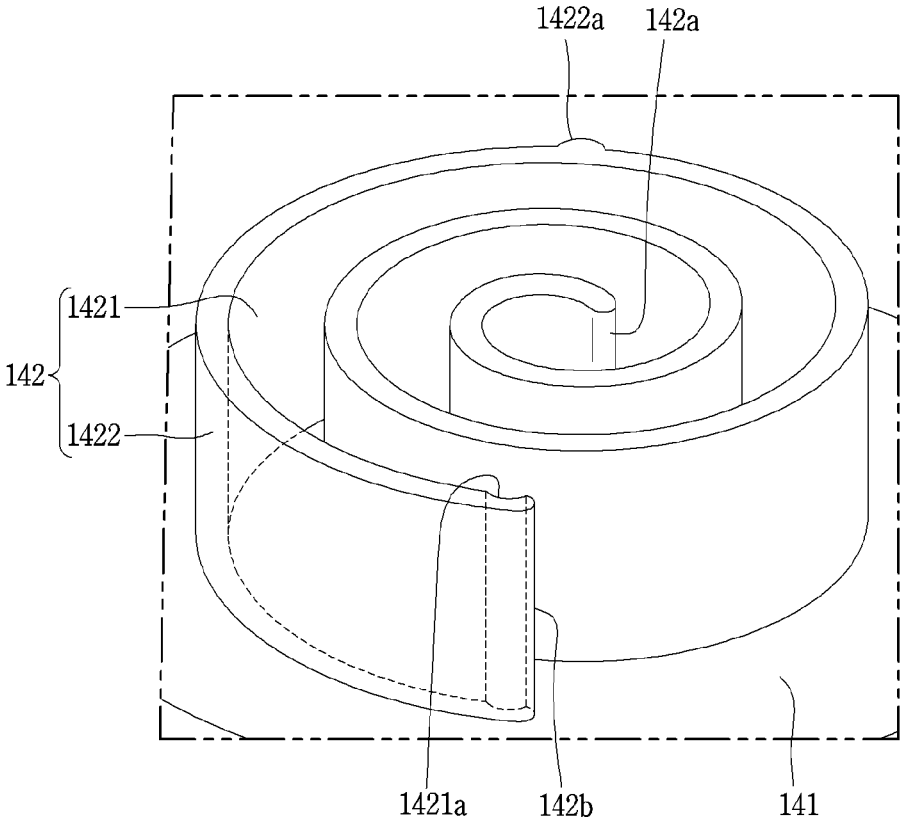
FIG. 3 is an enlarged perspective view illustrating a portion of an orbiting scroll in FIG. 2.
Figure 4:
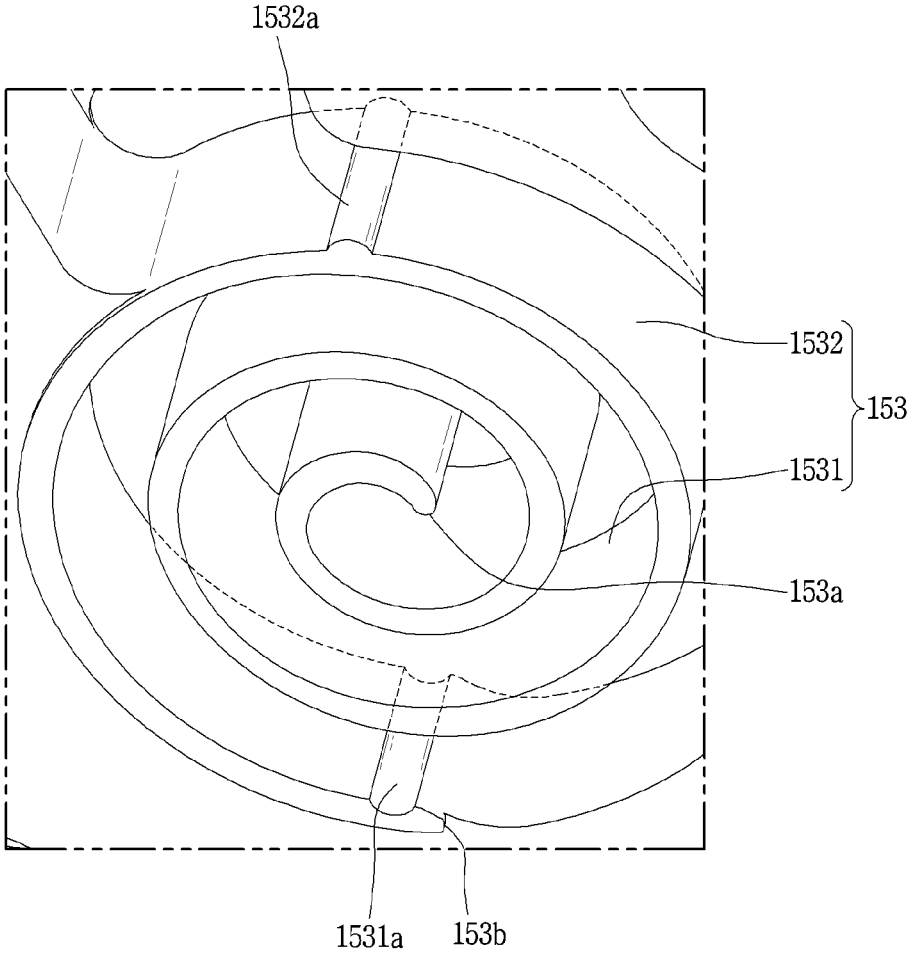
FIG. 4 is an enlarged perspective view illustrating a portion of a non-orbiting scroll in FIG. 2.

FIG. 1 is a longitudinal cross-sectional view illustrating an inner structure of a scroll compressor in accordance with an embodiment. FIG. 2 is an enlarged perspective view illustrating a compression unit in FIG. 1. FIG. 3 is an enlarged perspective view illustrating a portion of an orbiting scroll in FIG. 2, and FIG. 4 is an enlarged perspective view illustrating a portion of a non-orbiting scroll in FIG. 2.

Referring to FIG. 1, a scroll compressor according to an embodiment may include a drive motor 120 disposed in a lower half portion of a casing 110, and a main frame 130, an orbiting scroll 140, a non-orbiting scroll 150, and a back pressure chamber assembly 160 that are sequentially disposed at an upper side of the drive motor 120. In general, the drive motor 120 may constitute a motor unit, and the main frame 130, the orbiting scroll 140, the non-orbiting scroll 150, and the back pressure chamber assembly 160 may constitute a compression unit. The motor unit may be coupled to one (first) end of a rotary shaft 125, and the compression unit may be coupled to another (second) end of the rotary shaft 125. Accordingly, the compression unit may be connected to the motor unit by the rotary shaft 125 to be operated by a rotational force of the motor unit.

The casing 110 may include a cylindrical shell 111, an upper cap 112, and a lower cap 113. The cylindrical shell 111 may have a cylindrical shape with upper and lower ends open, and the drive motor 120 and the main frame 130 may be fitted on an inner circumferential surface of the cylindrical shell 111 in an inserting manner. A terminal bracket (not shown) may be coupled to an upper half portion of the cylindrical shell 111, and a terminal (not shown) that transmits external power to the drive motor 120 may be coupled through the terminal bracket. In addition, a refrigerant suction pipe 117 described hereinafter may be coupled through the upper half portion of the cylindrical shell 111, for example, the upper side of the drive motor 120.

The upper cap 112 may be coupled to cover the open upper end of the cylindrical shell 111, and the lower cap 113 may be coupled to cover the opened lower end of the cylindrical shell 111. A rim of a high/low separation plate 115 described hereinafter is inserted between the cylindrical shell 111 and the upper cap 112 to be, for example, welded to the cylindrical shell 111 and the upper cap 112, and a rim of a support bracket 116 described hereinafter may be inserted between the cylindrical shell 111 and the lower cap 113 to be, for example, welded to the cylindrical shell 111 and the lower cap 113. Accordingly, the inner space of the casing 110 may be sealed.

The rim of the high/low pressure separation plate 115, as aforementioned, may be welded to the casing 110 and a central portion of the high/low separation plate 115 may be bent to protrude toward the upper cap 112 so as to be disposed above the back pressure chamber assembly 160. A refrigerant suction pipe 117 communicates with a space below the high/low pressure separation plate 115, and a refrigerant discharge pipe 118 communicates with a space above the high/low separation plate 115. Accordingly, a low-pressure part or portion 110*a* constituting a suction space is formed below the high/low pressure separation plate 115, and a high-pressure part or portion 110*b* constituting a discharge space is formed above the high/low pressure separation plate 115.

In addition, the lower cap 113 may define an oil storage space 110*c* together with the lower half portion of the cylindrical shell 111 constituting the low-pressure part 110*a*. In other words, the oil storage space 110*c* may be defined in the lower half portion of the low-pressure part 110*a*. The oil storage space 110*c* defines a portion of the low-pressure part 110*a*.

Referring to FIG. 1, the drive motor 120 according to this embodiment is disposed in the lower half portion of the low-pressure part 110*a* and includes a stator 121 and a rotor 122. The stator 121, may be, for example, shrink-fitted to an inner wall surface of the casing 111, and the rotor 122 may be rotatably provided inside of the stator 121.

The stator 121 may include a stator core 1211 and a stator coil 1212. The stator core 1211 may be formed in a cylindrical shape and shrink-fitted onto the inner circumferential surface of the cylindrical shell 111. The stator coil 1212 may be wound around the stator core 1211 and electrically connected to an external power source through a terminal (not shown) that is coupled through the casing 110.

The rotor 122 may include a rotor core 1221 and permanent magnets 1222. The rotor core 1221 may be formed in a cylindrical shape, and rotatably inserted into the stator core 1211 with a preset or predetermined gap therebetween. The permanent magnets 1222 may be embedded in the rotor core 1222 at preset or predetermined intervals along a circumferential direction.

The rotary shaft 125 may be coupled to a center of the rotor core 1221. An upper end portion of the rotary shaft 125 may be rotatably inserted into the main frame 130 described hereinafter so as to be supported in a radial direction, and a lower end portion of the rotary shaft 125 may be rotatably inserted into the support bracket 116 to be supported in the radial and axial directions.

An eccentric portion 1251 that is eccentrically coupled to the orbiting scroll 140 described hereinafter may be disposed on the upper end portion of the rotary shaft 125, and an oil feeder 1252 that suctions oil stored in the lower portion of the casing 110 may be disposed at the lower end portion of the rotary shaft 125. An oil supply hole 1253 may be formed through the rotary shaft 125 in the axial direction.

Referring to FIG. 1, the main frame 130 according to this embodiment is disposed above the drive motor 120 and shrink-fitted or welded to an inner wall surface of the cylindrical shell 111. The main frame 130 may include a main flange portion 131, a main bearing portion 132, an orbiting space portion 133, a scroll support portion 134, an Oldham ring accommodation portion 135, and a frame fixing portion 136.

The main flange portion 131 may be formed in an annular shape and accommodated in the low-pressure part 110*a* of the casing 110. An outer diameter of the main flange portion 131 may be formed smaller than an inner diameter of the cylindrical shell 111 so that an outer circumferential surface of the main flange portion 131 is spaced apart from an inner circumferential surface of the cylindrical shell 111. However, the frame fixing portion 136 described hereinafter protrudes from the outer circumferential surface of the main flange portion 131 in the radial direction, and an outer circumferential surface of the frame fixing portion 136 is brought into close contact with and fixed to the inner circumferential surface of the casing 110. Accordingly, the frame 130 may be fixedly coupled to the casing 110.

The main bearing portion 132 protrudes downward from a lower surface of a central part or portion of the main flange portion 131 toward the drive motor 120. The main bearing portion 132 is provided with a bearing hole 132*a* formed therethrough in a cylindrical shape along the axial direction, and a main bearing (no reference numeral given) configured as a bush bearing is fitted to an inner circumferential surface of the bearing hole 132. The rotary shaft 125 may be inserted into the main bearing to be supported in the radial direction.

The orbiting space portion 133 is recessed from the central part of the main flange portion 131 toward the main bearing portion 132 by a preset or predetermined depth and outer diameter. The orbiting space portion 133 may be formed to be larger than an outer diameter of a rotary shaft coupling portion 143 provided on the orbiting scroll 140 described hereinafter. Accordingly, the rotary shaft coupling portion 143 may be pivotally accommodated in the orbiting space portion 133.

The scroll support portion 134 may be formed in an annular shape on an upper surface of the main flange portion 131 along a periphery of the orbiting space portion 133.

Accordingly, the scroll support portion 134 may support a lower surface of an orbiting end plate portion 141 described hereinafter in the axial direction.

The Oldham ring accommodation portion 135 may be formed in an annular shape in an upper surface of the main flange portion 131 along an outer circumferential surface of the scroll support portion 134. Accordingly, an Oldham ring 180 may be pivotably inserted into the Oldham ring accommodation portion 135.

The frame fixing portion 136 may be formed to extend radially from an outer periphery of the Oldham ring accommodation portion 135. The frame fixing portion 136 may extend in an annular shape or may extend to form a plurality of protrusions spaced apart from each other by a preset or predetermined distance. This embodiment illustrates an example in which the frame fixing portion 136 has a plurality of protrusions along the circumferential direction.

As the frame fixing portions 136 are disposed at the preset distance along the circumferential direction, a kind of suction guide space S is defined between the frame fixing portions 136. Accordingly, refrigerant suctioned into the low-pressure part 110*a* may be guided to a suction port 152*a* through the suction guide space S between the frame fixing portions 136.

Referring to FIGS. 1 and 2, the orbiting scroll 140 according to this embodiment is disposed on an upper surface of the main frame 130. An Oldham ring 180, which is an anti-rotation mechanism, may be disposed between the orbiting scroll 140 and the main frame 130 or between the orbiting scroll 140 and the non-orbiting scroll 150 described hereinafter so that the orbiting scroll 140 performs an orbiting motion.

The orbiting scroll 140 may include an orbiting end plate portion 141, an orbiting wrap 142, and the rotary shaft coupling portion 143. The orbiting end plate portion 141 may be formed approximately in a disk shape.

The orbiting wrap 142 may be formed in a spiral shape by protruding from an upper surface of the orbiting end plate portion 141 facing the non-orbiting scroll 150 to a preset or predetermined height. The orbiting wrap 142 may be formed to correspond to the non-orbiting wrap 153 to perform an orbiting motion by being engaged with a non-orbiting wrap 153 of the non-orbiting scroll 150 described hereinafter. The orbiting wrap 142 defines compression chambers V together with the non-orbiting wrap 153.

The compression chambers V may include a first compression chamber V1 formed at an inner surface of the orbiting wrap 142 and a second compression chamber V2 formed at an outer surface of the orbiting wrap 142. Each of the first compression chamber V1 and the second compression chamber V2 includes a suction pressure chamber (no reference numeral given), an intermediate pressure chamber (no reference numeral given), and a discharge pressure chamber (no reference numeral given) that are continuously formed. As the orbiting wrap 142 is spirally formed and refrigerant is compressed while moving from an edge side toward a center side, the compression chamber V is configured such that the suction pressure chamber is formed at the edge side of the orbiting wrap 142, the intermediate pressure chamber is formed from the edge side toward the center side of the orbiting wrap 142, and the discharge pressure chamber is formed at the center side of the orbiting wrap 142. Accordingly, an end of the edge side of the orbiting wrap 142 may be defined as a discharge end 142*a* and an end of the center side may be defined as a suction end 142*b*.

As described above, the orbiting wrap 142 is formed in a shape, when projected in the axial direction, which is spirally wound from a center portion toward the edge of the orbiting end plate portion 141. In other words, the orbiting wrap 142 continuously extends from the center portion toward the edge of the orbiting end plate portion 141, and here, its inner wrap and outer wrap are spaced apart from each other by a preset or predetermined gap to form the compression chambers V1 and V2 together with the non-orbiting wrap 153 described hereinafter.

The orbiting wrap 142 may have substantially a same wrap thickness from the discharge end 142*a* to the suction end 142*b* or may have different thicknesses. However, in these cases, a periphery of the discharge end 142*a* of the orbiting wrap 142 may be formed to be thicker than other portions in consideration of a pressure of the discharge pressure chamber. Therefore, wrap thickness may increase at the periphery of the discharge end 142*a* of the orbiting wrap 142 and a suction area may be secured at a periphery of the suction end 142*b*.

An inner surface 1421 and outer surface 1422 of the orbiting wrap 142 may be formed plane (flat) in most sections, except for a partial section, from the discharge end 142*a* to the suction end 142*b* of the orbiting wrap 142. For example, the inner surface 1421 of the orbiting wrap 142 may be formed to have a single radius of curvature or in some cases may be formed to have a plurality of radius of curvatures. In this embodiment, an example in which the inner surface 1421 of the orbiting wrap 142 is formed with the single radius of curvature, but this is merely illustrative and embodiments are not limited thereto.

Referring to FIG. 3, the inner surface 1421 of the orbiting wrap 142 may include a line-contact section A1 in which it is brought into line-contact with an outer surface 1532 of the non-orbiting wrap 153 described hereinafter, and a surface-contact section B1 in which it is brought into surface-contact with the outer surface 1532. The inner surface 1421 of the orbiting wrap 142 is brought into line-contact at a (first) portion thereof and into surface-contact at another (second) portion with the outer surface 1532 of the non-orbiting wrap 153. The inner surface 1421 of the orbiting wrap 142 may be formed with a typical radius of curvature in the line-contact section A1 while being formed in an arcuate shape having an arbitrary radius of curvature in the surface-contact section B1. Hereinafter, description will be given by defining the surface-contact section B1 of the inner surface 1421 of the orbiting wrap 142 as a first orbiting sealing surface 1421*a*. The first orbiting sealing surface 1421*a* constitutes a first sealing part or portion S1 together with a first non-orbiting sealing surface 1531*a* described hereinafter, which will be described hereinafter again with reference to FIGS. 5 to 7.

The outer side surface 1422 of the orbiting wrap 142 may be formed with a radius of curvature that is almost similar to that of the inner surface 1421 of the orbiting wrap 142. In other words, the outer surface 1422 of the orbiting wrap 142 includes a line-contact section A2 in which it is brought into line-contact with an inner surface 1531 of the non-orbiting wrap 153, and a surface-contact section B2 in which it is brought into surface-contact with the inner surface 1531. The outer surface 1422 of the orbiting wrap 142 is brought into line-contact at a (first) portion thereof and into surface-contact at another (second) portion with the inner surface 1531 of the non-orbiting wrap 153. The outer surface 1422 of the orbiting wrap 142 may be formed with a typical radius of curvature in the line-contact section A2 while being formed in an arcuate shape having an arbitrary radius of curvature in the surface-contact section B2. Hereinafter, description will be given by defining the surface-contact section B1 of the outer surface 1422 of the orbiting wrap 142 as a second orbiting sealing surface 1422*a*. The second orbiting sealing surface 1422*a* constitutes a second sealing part or portion S2 together with a first non-orbiting sealing surface 1531*a* described hereinafter, which will be described hereinafter again with reference to FIGS. 5 to 7.

The rotary shaft coupling portion 143 may protrude from a lower surface of the orbiting end plate portion 141 toward the main frame 130. The rotary shaft coupling portion 143 may be formed in a cylindrical shape, and an eccentric portion bearing (no reference numeral given) may be coupled to an inner circumferential surface of the rotary shaft coupling portion 143.

The non-orbiting scroll 150 according to this embodiment may be disposed on an upper portion of the orbiting scroll 140. The non-orbiting scroll 150 may be fixedly coupled to the main frame 130, or may be coupled to the main frame 130 to be movable up and down. This embodiment illustrates an example in which the non-orbiting scroll 150 is coupled to the main frame 130 to be movable relative to the main frame 130 in the axial direction.

Referring to FIGS. 1 and 2, the non-orbiting scroll 150 according to this embodiment may include a non-orbiting end plate portion 151, a non-orbiting side wall portion 152, and a non-orbiting wrap 153. The non-orbiting end plate portion 151 may be formed in a disk shape and disposed in a horizontal direction in the low-pressure part 110*a* of the casing 110. A discharge port 151*a*, a bypass hole 151*b*, and a scroll-side back pressure hole 151*c* may be formed through a central portion of the non-orbiting end plate portion 151 in the axial direction.

The discharge port 151*a* may be located at a position where a discharge pressure chamber (no reference numeral given) of the first compression chamber V1 and a discharge pressure chamber (no reference numeral given) of the second compression chamber V2 communicate with each other. The bypass hole 151*b* communicates with the first compression chamber V1 and the second compression chamber V2, respectively. The scroll-side back pressure hole (hereinafter, first back pressure hole) 151*c* may be spaced apart from the discharge port 151*a* and the bypass hole 151*b*.

The non-orbiting side wall portion 152 may extend in an annular shape from an edge of a lower surface of the non-orbiting end plate portion 151 in the axial direction. A suction port 152*a* may be formed through one side of an outer circumferential surface of the non-orbiting side wall portion 152 in the radial direction. The suction port 152*a* may be located at a higher position than the refrigerant suction pipe 117.

The non-orbiting side wall portion 152 has substantially a same height as the non-orbiting wrap 153, and a plurality of guide protrusions 155 extends from the outer circumferential surface of the non-orbiting side wall portion 152 in the radial direction. The plurality of guide protrusions 155 may be spaced apart from one another in the circumferential direction and a suction guide protrusion 156 that surrounds the suction port 152*a* is formed between any adjacent guide protrusions 155. The suction guide protrusion 156 is open toward the inner space 110*a* of the casing 110 such that the refrigerant suction pipe 117 and the suction port 152*a* communicate with each other. Accordingly, refrigerant suctioned into the inner space 110*a* of the casing 110 through the refrigerant suction pipe 117 may be suppressed or prevented from being in contact with the high/low separation plate 115.

Referring to FIG. 2, an inner surface 1531 of the non-orbiting wrap 153 may be formed in a spiral shape having a radius of curvature almost similar to that of the inner surface 1421 of the orbiting wrap 142, so as to be engaged with the inner surface 1421 of the orbiting wrap 142. In other words, the inner surface 1531 of the non-orbiting wrap 153 may include a line-contact section A3 in which it is brought into line-contact with the outer surface 1422 of the orbiting wrap 142, and a surface-contact section B3 in which it is brought into surface-contact with the outer surface 1422. The inner surface 1531 of the non-orbiting wrap 153 is brought into line-contact at a (first) portion thereof and into surface-contact at another (second) portion with the outer surface 1422 of the orbiting wrap 142. The inner surface 1531 of the non-orbiting wrap 153 may be formed with a typical radius of curvature in the line-contact section A3 while being formed in an arcuate shape having an arbitrary curvature radius in the surface-contact section B3, like the orbiting wrap 142. Hereinafter, description will be given by defining the surface-contact section B3 of the inner surface 1531 of the non-orbiting wrap 153 as a first non-orbiting sealing surface 1531*a*. The first non-orbiting sealing surface 1531*a*, as described above, constitutes the second sealing part S2 together with the second orbiting sealing surface 1422*a*, which will be described hereinafter again with reference to FIGS. 5 to 7.

Referring to FIG. 4, an outer surface 1541 of the non-orbiting wrap 153 may be formed in a spiral shape having a radius of curvature almost similar to that of the inner surface 1421 of the orbiting wrap 142, so as to be engaged with the inner surface 1421 of the orbiting wrap 142. In other words, the outer surface 1532 of the non-orbiting wrap 153 includes a line-contact section A4 in which it is brought into line-contact with the inner surface 1421 of the orbiting wrap 142, and a surface-contact section B4 in which it is brought into surface-contact with the outer surface 1532. The outer surface 1532 of the non-orbiting wrap 153 is brought into line-contact at a (first) portion thereof and into surface-contact at another (second) portion with the inner surface 1421 of the orbiting wrap 142. The outer surface 1532 of the non-orbiting wrap 153 may be formed with a typical radius of curvature in the line-contact section A4 while being formed in an arcuate shape having an arbitrary radius of curvature in the surface-contact section B4. Hereinafter, description will be given by defining the surface-contact section B4 of the outer surface 1532 of the non-orbiting wrap 153 as a second non-orbiting sealing surface 1532*a*. The second non-orbiting sealing surface 1532*a*, as described above, constitutes the first sealing part S1 together with the first orbiting sealing surface 1421*a*, which will be described hereinafter again with reference to FIGS. 5 to 7.

The back pressure chamber assembly 160 according to this embodiment is installed on an upper side of the non-orbiting scroll 150. Accordingly, the non-orbiting scroll 150 is pressed toward the orbiting scroll 140 by back pressure of the back pressure chamber 160*a* (more specifically, a force that back pressure applies to the back pressure chamber), so as to seal the compression chamber V.

Referring to FIG. 1, the back pressure chamber assembly 160 may include a back pressure plate 161 and a floating plate 165. The back pressure plate 161 may be coupled to the upper surface of the non-orbiting end plate portion 151 and the floating plate 165 may be slidably coupled to the back pressure plate 161 to define a back pressure chamber 160*a* together with the back pressure plate 161.

The back pressure plate 161 may include a fixed end plate portion 1611, a first annular wall portion 1612, and a second annular wall portion 1613. The fixed plate portion 1611 may be formed in an annular plate shape with a hollow center, and a plate-side back pressure hole (hereinafter, referred to as a second back pressure hole) 1611*a* may be formed through the fixed plate portion 1611 in the axial direction. The second back pressure hole 1611*a* may communicate with the first back pressure hole 151*c* so as to communicate with the back pressure chamber 160*a*. Accordingly, the second back pressure hole 1611*a* may communicate with the first back pressure hole 151*c* so that the compression chamber V and the back pressure chamber 160*a* may communicate with each other.

The first annular wall portion 1612 and the second annular wall portion 1613 may be formed on an upper surface of the fixed plate portion 1611 to surround inner and outer circumferential surfaces of the fixed plate portion 1611. An outer circumferential surface of the first annular wall portion 1612, an inner circumferential surface of the second annular wall portion 1613, the upper surface of the fixed plate portion 1611, and a lower surface of the floating plate 165 define the back pressure chamber 160*a* in the annular shape.

The first annular wall portion 1612 may be provided with an intermediate discharge port 1612*a* that communicates with the discharge port 151*a* of the non-orbiting scroll 150, a valve guide groove 1612*c* in which a check valve 157 is slidably inserted may be formed in the intermediate discharge port 1612*a*, and a backflow prevention hole 1612*c* may be formed in a central portion of the valve guide groove 1612*b*. Accordingly, the check valve 157 may be selectively opened and closed between the discharge port 151*a* and the intermediate discharge port 1612*a* to suppress or prevent discharged refrigerant from flowing back into the compression chamber.

The floating plate 165 may be formed in an annular shape and formed of a lighter material than the back pressure plate 161. Accordingly, the floating plate 165 may be attached to and detached from a lower surface of the high/low pressure separation plate 115 while moving in the axial direction with respect to the back pressure plate 161 depending on the pressure of the back pressure chamber 160*a*.

In the drawings, unexplained reference numeral O denotes an axial center or orbiting center.

The scroll compressor according to this embodiment may operate as follows.

That is, when power is applied to the stator coil 1212 of the stator 121, the rotor 122 rotates together with the rotary shaft 125. The orbiting scroll 140 coupled to the rotary shaft 125 performs the orbiting motion with respect to the non-orbiting scroll 150, thereby forming a pair of compression chambers V between the orbiting wrap 142 and the non-orbiting wrap 153. The compression chamber V gradually decreases in volume while moving from outside to inside according to the orbiting motion of the orbiting scroll 140.

The refrigerant is suctioned into the low-pressure part 110*a* of the casing 110 through the refrigerant suction pipe 117. A part or portion of this refrigerant is suctioned into the first compression chamber V1 and the second compression chamber V2. The refrigerant is then compressed while moving along a movement path of each compression chamber V1, V2. The compressed refrigerant partially flows into the back pressure chamber 160*a* through the first back pressure hole 151*c* before arriving at the discharge port 151*a*. Accordingly, the back pressure chamber 160*a* constituted by the back pressure plate 161 and the floating plate 165 forms an intermediate pressure.

The floating plate 165 rises toward the high/low pressure separation plate 115 to be brought into close contact with the sealing plate 1151 provided on the high/low pressure separation plate 115. The high-pressure part 110*b* of the casing 110 is separated from the low-pressure part 110*a*, to suppress or prevent the refrigerant discharged from each compression chamber V1 and V2 from flowing back into the low-pressure part 110*a*.

On the other hand, the back pressure plate 161 is pushed down by the pressure of the back pressure chamber 160*a* applied toward the non-orbiting scroll 150, so as to press the non-orbiting scroll 150 toward the orbiting scroll 140. Accordingly, the non-orbiting scroll 150 is brought into close contact with the orbiting scroll 140 to suppress or prevent the compressed refrigerant from leaking from a high-pressure side compression chamber, which forms an intermediate pressure chamber, to a low-pressure side compression chamber in the axial direction.

Also, while the orbiting scroll 140 performs the orbiting motion relative to the non-orbiting scroll 150, the orbiting wrap 142 is brought into close contact with the non-orbiting wrap 153 in the radial direction, thereby restricting leakage of refrigerant from a high-pressure side compression chamber to a low-pressure side compression chamber in a tangential direction. In other words, in a state in which the inner surface 1421 and the outer surface 1422 of the orbiting wrap 142 are brought into line-contact (point-contact when projected in the axial direction) with the outer surface 1532 and the inner surface 1531 of the non-orbiting wrap 153, respectively, the orbiting wrap 142 and the non-orbiting wrap 153 slide to provide a seal between the suction port 152*a* and the compression chambers V1 and V2 and between the high-pressure side compression chamber and the low-pressure type compression chamber.

However, the related art may fail to secure sufficient sealing areas at a contact section between the inner surface of the orbiting wrap and the outer surface of the non-orbiting wrap and a contact section between the outer surface of the orbiting wrap and the inner surface of the non-orbiting wrap. This may cause leakage between the compression chambers in the tangential direction, thereby bringing about recompression loss and reduction of volumetric efficiency.

Therefore, according to the embodiment described above, in the section where the inner surface of the orbiting wrap is in contact with the outer surface of the non-orbiting wrap, a (first) portion is maintained in a line-contact state while another (second) portion is maintained in a surface-contact state, so as to secure both a wide sealing area and a wide film formation area between the inner surface of the orbiting wrap and the outer surface of the non-orbiting wrap. This is similarly achieved in the section where the outer surface of the orbiting wrap and the inner surface of the non-orbiting wrap are in contact with each other.

Figure 5:
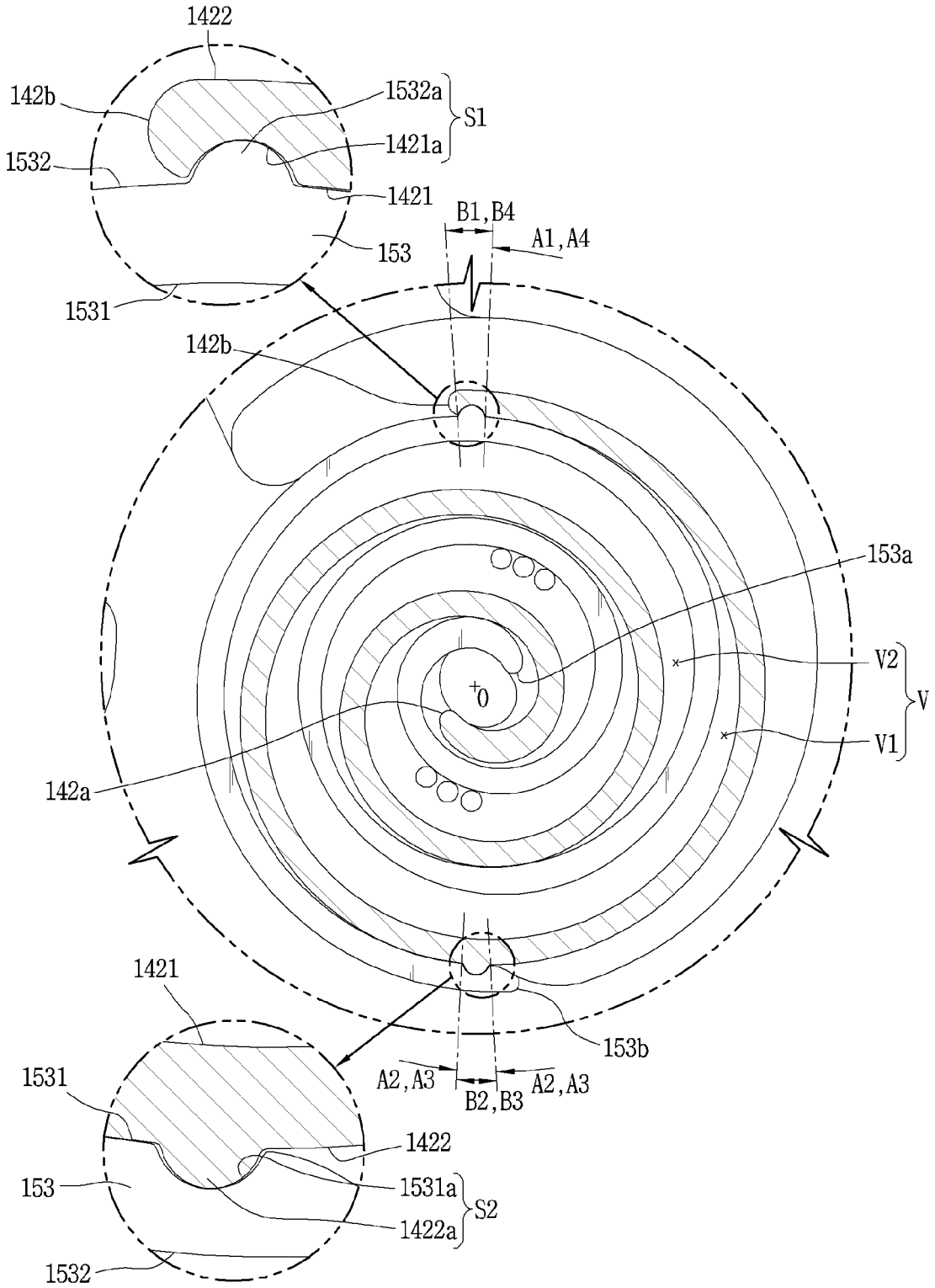
FIG. 5 is an assembled planar view illustrating the compression unit of FIG. 5.
Figure 6:
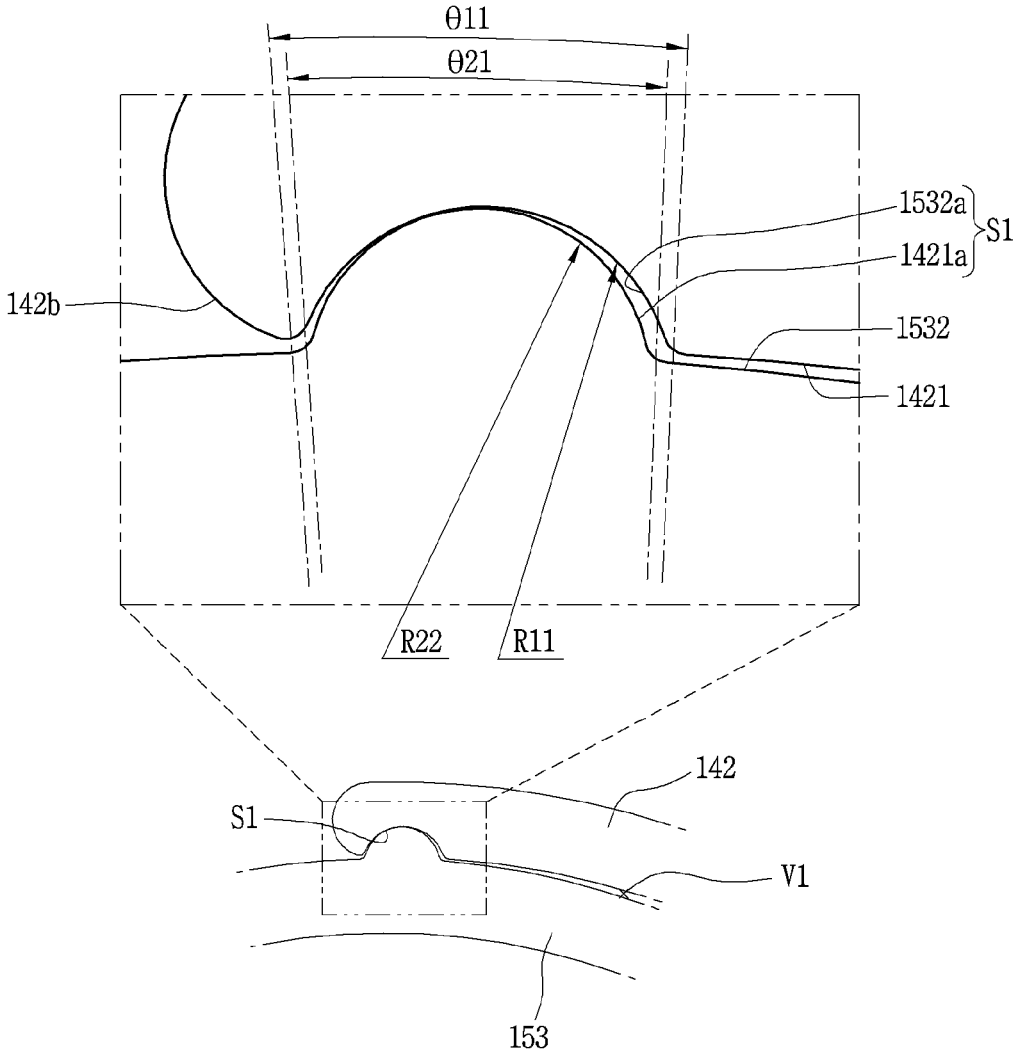
FIG. 6 is an enlarged planar view illustrating a first sealing part of FIG. 5.
Figure 7:
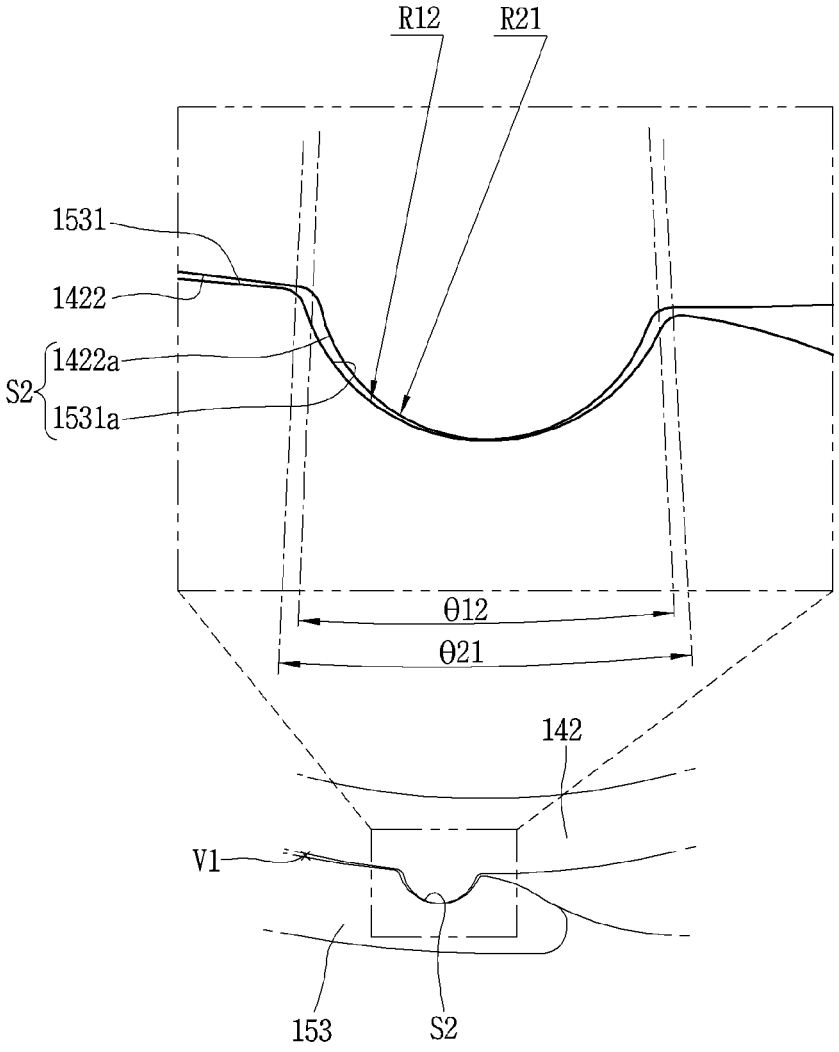
FIG. 7 is an enlarged planar view illustrating a second sealing part of FIG. 5.

FIG. 5 is an assembled planar view illustrating the compression unit of FIG. 5. FIG. 6 is an enlarged planar view illustrating a first sealing part of FIG. 5, and FIG. 7 is an enlarged planar view illustrating a second sealing part of FIG. 5.

Referring to FIGS. 5 and 6, the inner surface 1421 of the orbiting wrap 142 according to this embodiment may include, as aforementioned, the line-contact section A1 and the surface-contact section B1. In other words, the inner surface 1421 of the orbiting wrap 142 according to this embodiment is in line-contact in a section thereof and surface-contact in another section with the outer surface 1532 of the non-orbiting wrap 153. Accordingly, an increase in friction loss between the inner surface 1421 of the orbiting wrap 142 and the outer surface 1532 of the non-orbiting wrap 153 may be minimized in the line-contact section while a sealing area between the inner surface 1421 of the orbiting wrap 142 and the outer surface 1532 of the non-orbiting wrap 153 may be secured in the surface-contact section, thereby suppressing or preventing leakage between the suction port 152*a* and the first compression chamber V1 and/or the second compression chamber V2.

The line-contact section A1 defined in the inner surface 1421 of the orbiting wrap 142 may be defined in a section from the discharge end 142*a* to an arbitrary first point. The arbitrary first point may be located between the suction end 142*b* and a suction completion angle, but may be located to be as adjacent to the suction end 142*b* as possible in terms of securing substantially a maximum suction volume for both the compression chambers V1 and V2.

The surface-contact section B1 defined in the inner surface 1421 of the orbiting wrap 142 may be defined in a section from the arbitrary first point, namely, a suction-side end of the line-contact section A1 to an arbitrary second point. The arbitrary second point, as aforementioned, may be located closer to the suction side than the first point, that is, at the suction end 142*b*. In other words, the surface-contact section B1 may be defined from an end of the line-contact section A1 to the suction end 142*b*.

A radius of curvature of the surface-contact section B1 disposed in the inner surface 1421 of the orbiting wrap 142 may be different from a radius of curvature of the line-contact section A1. In other words, the radius of curvature of the surface-contact section B1 may be shorter than the radius of curvature of the line-contact section A1. Accordingly, the surface-contact section B1 may be recessed into the inner surface 1421 of the orbiting wrap 142 to be deeper than an inner circumferential surface of the line-contact section A1, so as to have a groove shape with a preset or predetermined depth, for example, an arcuate cross-sectional shape. Accordingly, a protrusion having an arcuate cross-sectional shape which is disposed on the outer surface 1532 of the non-orbiting wrap 153 may be inserted into the surface-contact section B1, thereby defining first sealing part S1, in which the surface-contact is made, together with the protrusion. In the following description, the groove in the arcuate cross-sectional shape formed in the surface-contact section B1 of the inner surface 1421 of the orbiting wrap 142 is defined as first orbiting sealing surface 1421*a* of the first sealing part S1. The first orbiting sealing surface 1421*a* will be described hereinafter together with a second non-orbiting sealing surface 1532*a*.

The outer surface 1422 of the orbiting wrap 142 may be formed with a radius of curvature which is almost similar to that of the inner surface 1421 of the orbiting wrap 142. Accordingly, a basic description for the outer surface 1422 of the orbiting wrap 142 will be replaced with the description for the inner surface 1421 of the orbiting wrap 142.

However, the outer surface 1422 of the orbiting wrap 142 includes the line-contact section A2 and the surface-contact section B2, like the inner surface 1421, but the surface-contact section B2 may be located in the middle of the line-contact section A2, unlike the inner surface 1421 of the orbiting wrap 142. In other words, the outer surface 1422 of the orbiting wrap 142 may be formed by including the line-contact section A2 from the discharge end 142*a* to an arbitrary third point, the surface-contact section B2 from a suction-side end of the third point to an arbitrary fourth point, and the line-contact section A2 again from the suction-side end of the surface-contact section B2 to the suction end 142*b*.

The surface-contact section B2 defined in the outer surface 1422 of the orbiting wrap 142 may be defined in a section from the arbitrary third point, namely, a suction-side end of the line-contact section A2 to the arbitrary fourth point. The arbitrary fourth point, as aforementioned, may be located closer to the suction side than the third point, that is, closer to the discharge end 142*a* than to the suction end 142*b*.

The surface-contact section B2 of the outer surface 1422 of the orbiting wrap 142 may be formed in a protrusion shape in an arcuate cross-sectional shape, which is in surface-contact with the first non-orbiting sealing surface 1531*a* disposed in a groove shape having an arcuate cross-sectional shape in the inner surface 1531 of the non-orbiting wrap 153. In the following description, the protrusion in the arcuate cross-sectional shape formed in the surface-contact section B2 of the outer surface 1422 of the orbiting wrap 142 is defined as second orbiting sealing surface 1422*a* of the second sealing part S2. The second orbiting sealing surface 1422*a* will be described hereinafter together with the first non-orbiting sealing surface 1531*a*.

Referring to FIGS. 5 and 7, the inner surface 1531 of the non-orbiting wrap 153 according to this embodiment may include, as aforementioned, the line-contact section A3 and the surface-contact section B3. The line-contact section A3 is a section in line-contact with the outer surface 1422 of the orbiting wrap 142, while the surface-contact section B3 is a section in surface-contact with the outer surface 1422 of the orbiting wrap 142. Accordingly, the second compression chamber V2 may be hermetically sealed even if the outer surface 1422 of the orbiting wrap 142 and the inner surface 1531 of the non-orbiting wrap 153 slide relative to each other.

The line-contact section A3 of the inner surface 1531 of the non-orbiting wrap 153 may be defined between the discharge end 153*a* of the non-orbiting wrap 153 and an arbitrary fifth point, while the surface-contact section B3 of the inner surface 1531 of the non-orbiting wrap 153 may be defined between the arbitrary fifth point and the suction end 153*b* of the non-orbiting wrap 153. In other words, the surface-contact section B3 disposed in the inner surface 1531 of the non-orbiting wrap 153 may be continuously formed from the end of the line-contact section A3 to the suction end 153*b*. Therefore, the inner surface 1531 of the non-orbiting wrap 153 may have the first non-orbiting sealing surface 1531*a* corresponding to the second orbiting sealing surface 1422*a*.

The first non-orbiting sealing surface 1531*a* may have a cross-sectional shape of a groove recessed by a preset or predetermined depth such that the second orbiting sealing surface 1422*a* is inserted to be in surface-contact therewith. Accordingly, the first non-orbiting sealing surface 1531*a* and the second orbiting sealing surface 1422*a* can be brought into contact with each other in correspondence with the orbiting motion of the orbiting scroll 140, thereby extending a contact length between both the sealing surfaces 1531*a* and 1422*a* to a maximum within a same rotational angle range.

In this case, the first non-orbiting sealing surface 1531*a* may be formed in an arcuate cross-sectional shape in which a radius of curvature R21 thereof is larger than or equal to a radius of curvature R12 of the second orbiting sealing surface 1422*a*. In other words, the radius of curvature R21 of the first non-orbiting sealing surface 1531*a* and the radius of curvature R12 of the second orbiting sealing surface 1422*a* may be larger than or equal to an orbiting radius of the orbiting scroll 140. This may maintain the surface contact between both the sealing surfaces 1531*a* and 1422*a* and facilitate machining of both the sealing surfaces 1531*a* and 1422*a*. In addition, an inner circumferential surface of the second non-orbiting sealing surface 1532*a* and the first orbiting sealing surface 1421*a* do not interfere with each other during the orbiting motion of the orbiting scroll 140. Accordingly, during the orbiting motion of the orbiting scroll 140, the surface-contact state between the inner circumferential surface of the second non-orbiting sealing surface 1532*a* and an outer circumferential surface of the second orbiting sealing surface 1422*a* may be maintained.

Also, a central angle 821 of the first non-orbiting sealing surface 1531*a* may be larger than or equal to a central angle 812 of the second orbiting sealing surface 1422*a*. For example, the central angle 821 of the first non-orbiting sealing surface 1531*a* may be equal to the central angle 812 of the second orbiting sealing surface 1422*a*. Therefore, during the orbiting motion of the orbiting scroll 140 relative to the non-orbiting scroll 150, the outer circumferential surface of the first non-orbiting sealing surface 1531*a* may be in the surface-contact state with the inner circumferential surface of the second orbiting sealing surface 1422*a* as long as possible, thereby effectively suppressing or preventing leakage from the second compression chamber V2 in the tangential direction.

Also, the first non-orbiting sealing surface 1531*a*, like the second orbiting sealing surface 1422*a*, may be formed across both axial ends of the non-orbiting wrap 153 to have the same radius of curvature along the axial direction. Therefore, the first non-orbiting sealing surface 1531*a* may maintain a constant sealing area together with the second orbiting sealing surface 1422*a* along the axial direction while being in contact with the second orbiting sealing surface 1422*a* widely and tightly in the axial direction.

On the other hand, the line-contact section A4 disposed in the outer surface 1532 of the non-orbiting wrap 153 may be defined between the discharge end 153*a* and an arbitrary seventh point, the surface-contact section B4 disposed in the outer surface 1532 of the non-orbiting wrap 153 may be defined between the arbitrary seventh point and an arbitrary eighth point P8 close to the suction end 153*b*, and the line-contact section A4 disposed in the outer surface 1532 of the non-orbiting wrap 153 may be defined again between the arbitrary eighth point P8 and the suction end 153*b*. In other words, the surface-contact section B4 disposed in the outer surface 1532 of the non-orbiting wrap 153 may be formed in the middle of the line-contact section A4. Therefore, the outer surface 1532 of the non-orbiting wrap 153 may have the second non-orbiting sealing surface 1532*a* defining the first sealing part S1 to correspond to the first orbiting sealing surface 1421*a*.

The second non-orbiting sealing surface 1532*a* may be formed in a cross-sectional shape of a protrusion that protrudes to be inserted into the first orbiting sealing surface 1421*a* to be in surface-contact. The second non-orbiting sealing surface 1532*a* may be formed in an arcuate cross-sectional shape in which a radius of curvature R22 thereof is smaller than or equal to a radius of curvature R11 of the first orbiting sealing surface 1421*a*. In other words, the radius of curvature R22 of the second non-orbiting sealing surface 1531*a* and the radius of curvature R11 of the first orbiting sealing surface 1421*a* may be larger than or equal to the orbiting radius of the orbiting scroll 140. Therefore, during the orbiting motion of the orbiting scroll 140, the outer circumferential surface of the second non-orbiting sealing surface 1532*a* may be continuously in the surface-contact state with the inner circumferential surface of the first orbiting sealing surface 1421*a* while being inserted in the first orbiting sealing surface 1421*a*.

Also, a central angle 822 of the second non-orbiting sealing surface 1532*a* may be larger than or equal to a central angle 811 of the first orbiting sealing surface 1421*a*. For example, the central angle 822 of the second non-orbiting sealing surface 1532*a* may be equal to the central angle 811 of the first orbiting sealing surface 1421*a*. Therefore, during the orbiting motion of the orbiting scroll 140, the outer circumferential surface of the second non-orbiting sealing surface 1532*a* may be in the surface-contact state with the first orbiting sealing surface 1421*a* as long as possible, thereby effectively suppressing or preventing leakage from the second compression chamber V2 in the tangential direction.

Also, the second non-orbiting sealing surface 1532*a*, like the first orbiting sealing surface 1421*a*, may have the same radius of curvature along the axial direction. Accordingly, the second non-orbiting sealing surface 1532*a* may be in surface-contact with the first orbiting sealing surface 1421*a* widely and tightly in the axial direction.

In this way, mostly in the contact portion between the inner surface of the orbiting wrap and the outer surface of the non-orbiting wrap and the contact portion between the outer surface of the orbiting wrap and the inner surface of the non-orbiting wrap, the line-contact may be maintained to suppress or prevent friction loss between the wraps. This may result in improving compression efficiency of the compressor.

At the same time, at portions adjacent to the suction end of the orbiting wrap and the suction end of the non-orbiting wrap, side surfaces of both the wraps may be in surface-contact with each other, thereby securing a sealing area between the orbiting wrap and the non-orbiting wrap. This may suppress or prevent refrigerant suctioned into each compression chamber from leaking back into a suction pressure chamber, thereby improving indicated efficiency and volumetric efficiency of the compressor.

Hereinafter, another embodiment of an orbiting wrap and a non-orbiting wrap will be described.

That is, in the previous embodiment, a central angle of a sealing surface defining a groove is larger than or equal to a central angle of a sealing surface defining a protrusion. However, in some cases, the central angle of the sealing surface defining the groove is smaller than the central angle of the sealing surface defining the protrusion.

Figure 8:
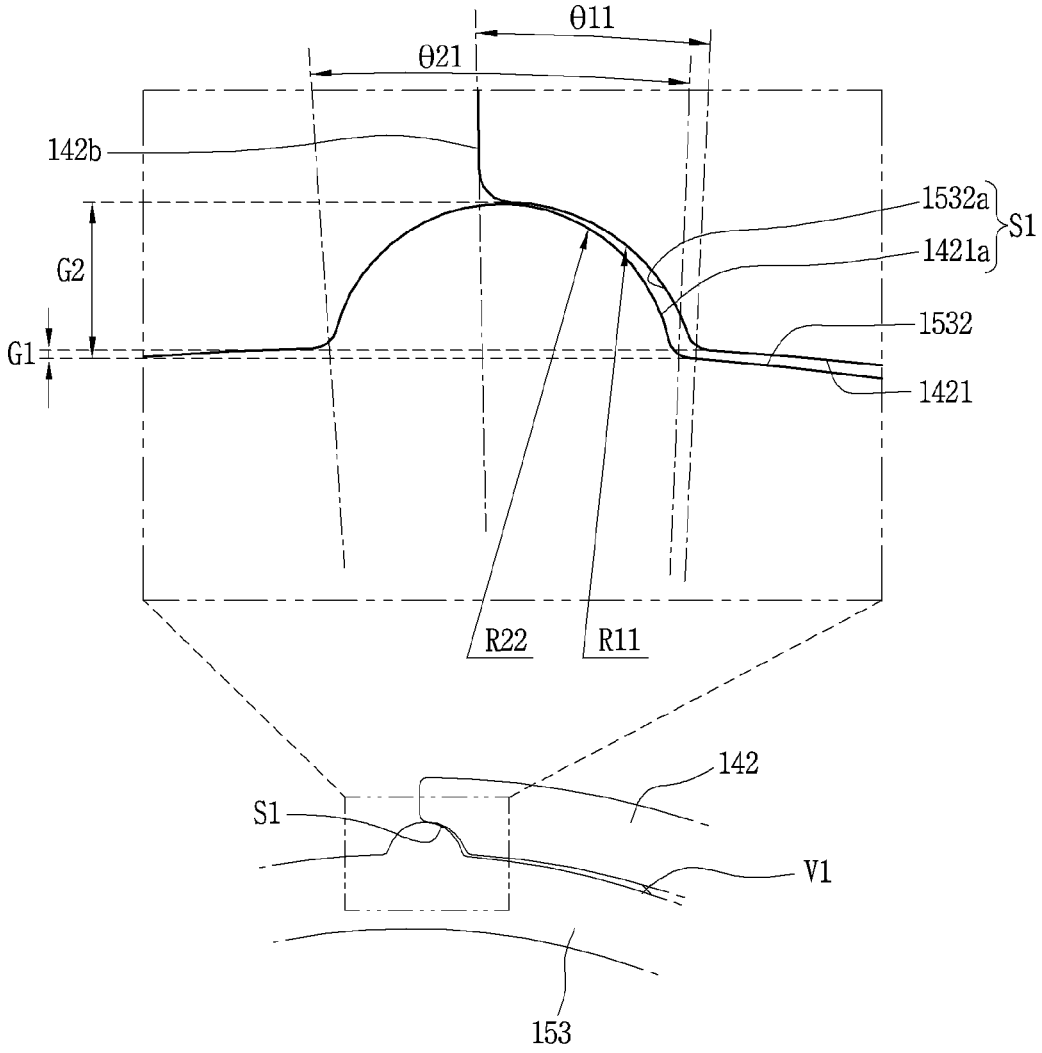
FIG. 8 is a planar view illustrating another embodiment of the first sealing part of FIG. 5.
Figure 9:
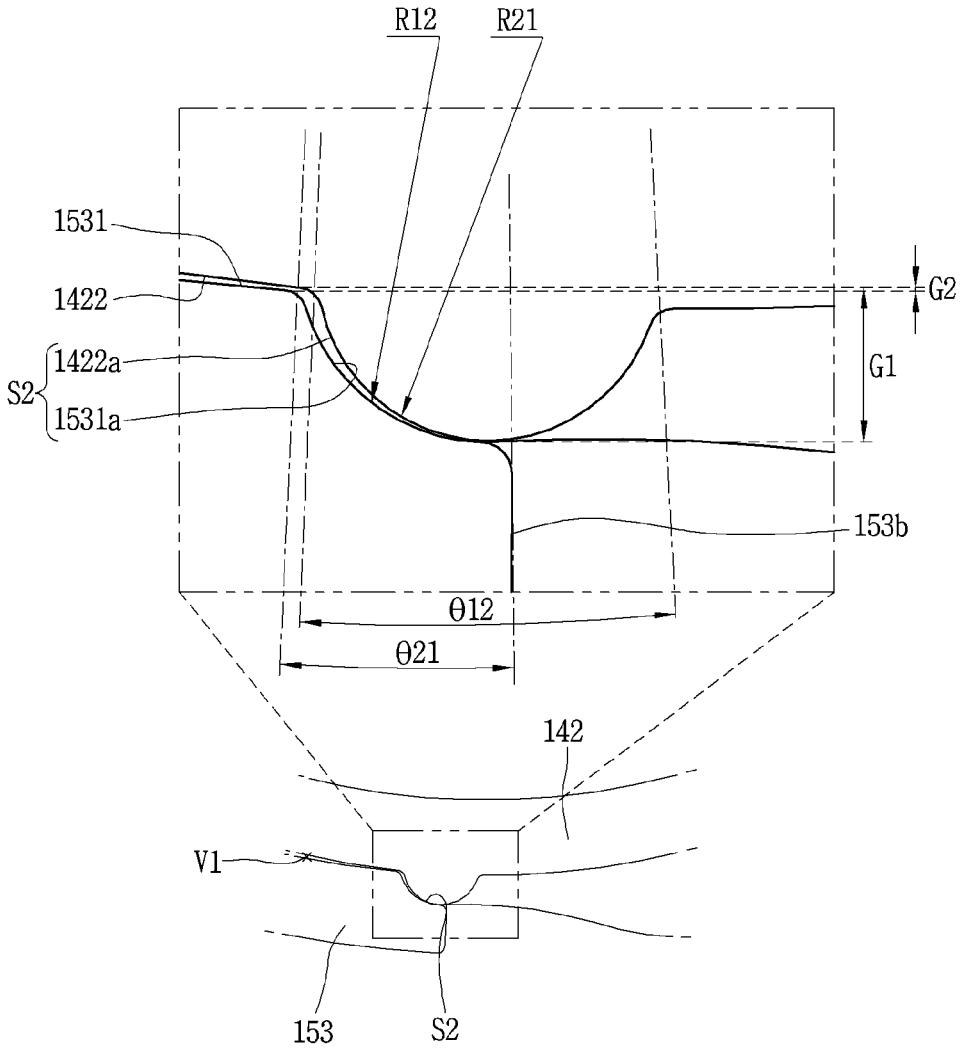
FIG. 9 is a planar view illustrating another embodiment of the second sealing part of FIG. 5.

FIG. 8 is a planar view illustrating another embodiment for the first sealing part of FIG. 5. FIG. 9 is a planar view illustrating another embodiment of the second sealing part of FIG. 5.

Referring to FIGS. 8 and 9, according to this embodiment, the first orbiting sealing surface 1421*a* is formed on the inner surface 1421 of the orbiting wrap 142 and the second orbiting sealing surface 1422*a* is formed on the outer surface 1422 of the orbiting wrap 142. The first non-orbiting sealing surface 1531*a* is formed on the inner surface 1531 of the non-orbiting wrap 153 and the second non-orbiting sealing surface 1532*a* is formed on the outer surface 1532 of the non-orbiting wrap 153. The first orbiting sealing surface 1421*a* is formed as a groove in an arcuate cross-sectional shape, and the second non-orbiting sealing surface 1532*a* is formed as a protrusion in an arcuate cross-sectional shape. The first non-orbiting sealing surface 1531*a* is formed as a groove in an arcuate cross-sectional shape, and the second orbiting sealing surface 1422*a* is formed as a protrusion in an arcuate cross-sectional shape. Accordingly, the first orbiting sealing surface 1421*a* and the second non-orbiting sealing surface 1532*a* are engaged with each other to define the first sealing part S1, and the first non-orbiting sealing surface 1531*a* and the second orbiting sealing surface 1422*a* are engaged with each other to define the second sealing part S2. The positions and shapes of the sealing surfaces are similar to those of the previous embodiment, and thus, description thereof will be replaced with the description of the previous embodiment.

However, in this embodiment, the central angle 811 of the first non-orbiting sealing surface 1421*a* may be smaller than the central angle 822 of the second non-orbiting sealing surface 1532*a* facing the first non-orbiting sealing surface 1421*a*. For example, when the central angle 822 of the second non-orbiting sealing surface 1532*a* is about 180°, the central angle 811 of the first orbiting sealing surface 1421*a* may be about 90°. Therefore, a wrap thickness on the first orbiting sealing surface 1421*a* may gradually decrease toward the suction end 142*b* of the orbiting wrap 142. Accordingly, a gap G1 between the orbiting wrap 142 and the non-orbiting wrap 153 at the suction end 142*b* of the orbiting wrap 142 may be larger than a gap G2 in a section excluding the first orbiting sealing surface 1421*a*. This may facilitate machining of the first orbiting sealing surface 1421*a* and also widen a suction area for the first compression chamber V1 to improve volumetric efficiency of refrigerant.

This is similarly achieved even for the first non-orbiting sealing surface 1531*a* and the second orbiting sealing surface 1422*a* defining the second sealing part S2. In other words, as the central angle 821 of the first non-orbiting sealing surface 1531*a* is smaller than the central angle 812 of the second orbiting sealing surface 1422*a*, a wrap thickness at the first non-orbiting sealing surface 1531*a* may gradually decrease toward the suction end 153*b* of the non-orbiting wrap 153. Accordingly, a gap G1 between the non-orbiting wrap 153 and the orbiting wrap 142 at the suction end 153*b* of the non-orbiting wrap 153 may be larger than a gap G2 in a section excluding the first non-orbiting sealing surface 1531*a*. This may facilitate machining of the first non-orbiting sealing surface 1531*a* and also widen a suction area for the second compression chamber V2 to improve volumetric efficiency of refrigerant.

On the other hand, in the previous embodiments, the first orbiting sealing surface 1421*a* and the first non-orbiting sealing surface 1531*a* are formed in the shape of the recessed groove and the second orbiting sealing surface 1422*a* and the second non-orbiting sealing surface 1532*a* are formed in the shape of the protrusion. However, even if they are formed conversely, the same/like operating effects can be obtained.

Embodiments disclosed herein provide a scroll compressor capable of improving indicated efficiency and volumetric efficiency by suppressing or preventing leakage of refrigerant suctioned into a compression chamber.

Embodiments disclosed herein provide a scroll compressor capable of securing a sealing area between wraps facing each other by surface-contact between portions of side surfaces of the wraps.

Embodiments disclosed herein further provide a scroll compressor capable of forming sealing surfaces such that portions of side surfaces of wraps facing each other are in surface-contact with each other, and simultaneously maintaining the sealing surfaces constantly.

Embodiments disclosed herein furthermore provide a scroll compressor capable of increasing a suction area while securing a sealing area between side surfaces of wraps facing each other.

Embodiments disclosed herein provide a scroll compressor that may include an orbiting scroll having an orbiting wrap formed on one side surface of an orbiting end plate portion to perform an orbiting motion; and a non-orbiting scroll having a non-orbiting wrap formed on one side surface of a non-orbiting end plate portion facing the orbiting end plate portion and engaged with the orbiting wrap to form compression chambers. A first sealing part or portion may be defined between an inner surface of the orbiting wrap and an outer surface of the non-orbiting wrap facing the inner surface of the orbiting wrap in a radial direction, and a second sealing part or portion may be defined between an inner surface of the non-orbiting wrap and an outer surface of the orbiting wrap facing the inner surface of the non-orbiting wrap in the radial direction. At least one of the first sealing part or the second sealing part may have sealing surfaces where both the wraps facing each other are in surface-contact with each other. This may enlarge a sealing area between side surfaces of the wraps facing each other to suppress or prevent leakage of refrigerant suctioned in a compression chamber, thereby improving indicated efficiency and volumetric efficiency.

For example, the sealing surfaces may be formed such that surfaces in surface-contact are engaged with each other. This may secure a long contact length between both the sealing surfaces within a range of a same rotational angle.

As another example, the sealing surfaces may be formed such that surfaces in surface-contact are formed as curved surfaces to be engaged with each other. With this configuration, the sealing surfaces may be in contact with each other during the orbiting motion of the orbiting scroll, thereby extending a contact length between both the sealing surfaces to a maximum within a range of the same rotational angle.

For example, the sealing surfaces may be formed such that each of sealing surfaces located on the inner surface of the orbiting wrap and the inner surface of the non-orbiting wrap has a radius of curvature that is larger than or equal to a radius of curvature of each of sealing surfaces located on the outer surface of the non-orbiting wrap and the outer surface of the orbiting wrap. Accordingly, the surface-contact between both the sealing surfaces facing each other may be maintained and also machining of both the sealing surfaces may be facilitated.

More specifically, the radius of curvatures of the sealing surfaces may be larger than an orbiting radius of the orbiting scroll. Accordingly, the surface-contact between both the sealing surfaces facing each other may be maintained and also machining of both the sealing surfaces may be further facilitated.

As another example, the sealing surfaces may be formed across both axial ends of the orbiting wrap and the non-orbiting wrap. This may constantly maintain a sealing area in a sealing part or portion defined between both the wraps.

For example, the sealing surfaces may be formed such that surfaces facing each other are formed as curved surfaces to be engaged with each other, and the curved surfaces defining the sealing surfaces may have the same radius of curvature along an axial direction. This may more constantly maintain the sealing area in a sealing part defined between both the wraps.

As another example, the first sealing part may include a first orbiting sealing surface formed on the inner surface of the orbiting wrap, and a second non-orbiting sealing surface disposed on the outer surface of the non-orbiting wrap to be in surface-contact with the first orbiting sealing surface. The second sealing part may include a first non-orbiting sealing surface formed on the inner surface of the non-orbiting wrap, and a second orbiting sealing surface disposed on the outer surface of the orbiting wrap to be in surface-contact with the first non-orbiting sealing surface. This may effectively suppress or prevent leakage of refrigerants suctioned into both compression chambers.

For example, the first orbiting sealing surface may be recessed into the inner surface of the orbiting wrap, and the second non-orbiting sealing surface may protrude from the outer surface of the non-orbiting wrap. The first non-orbiting sealing surface may be recessed into the inner surface of the non-orbiting wrap, and the second orbiting sealing surface may protrude from the outer surface of the orbiting wrap. With this configuration, with respect to a same rotational angle, a tangential length of both the sealing parts may extend to widen an inter-wrap contact area and a film formation area, thereby effectively suppressing or preventing refrigerant leakage from both compression chambers.

More specifically, a radius of curvature of the first orbiting sealing surface may be larger than or equal to a radius of curvature of the second non-orbiting sealing surface. A radius of curvature of the first non-orbiting sealing surface may be larger than or equal to a radius of curvature of the second orbiting sealing surface. Accordingly, the surface-contact between both the sealing surfaces facing each other may be maintained and also machining of both the sealing surfaces may be facilitated.

Also, the radius of curvature of the second non-orbiting sealing surface and the radius of curvature of the second orbiting sealing surface may be larger than an orbiting radius of the orbiting scroll. Accordingly, as the sealing surfaces does not interfere with the orbiting motion of the orbiting scroll, and thus, a constant sealing area may be maintained between both the wraps.

Also, a central angle of the first orbiting sealing surface may be larger than or equal to a central angle of the second non-orbiting sealing surface. A central angle of the first non-orbiting sealing surface may be larger than or equal to a central angle of the second orbiting sealing surface. Accordingly, both the sealing surfaces may be continuously brought into contact with each other during the orbiting motion of the orbiting scroll, thereby securing a long (wide) area of the sealing surfaces.

Also, a central angle of the first orbiting sealing surface may be smaller than a central angle of the second non-orbiting sealing surface. A central angle of the first non-orbiting sealing surface may be smaller than a central angle of the second orbiting sealing surface. This may facilitate machining of the sealing surfaces and increase a gap between the wraps on the sealing surfaces, thereby widening a suction area.

As another example, the sealing surface disposed on the inner surface of the orbiting wrap may extend from a suction end of the orbiting wrap. The sealing surface disposed on the inner surface of the non-orbiting wrap may extend from a suction end of the non-orbiting wrap. Accordingly, the sealing surfaces may be formed to be in contact with the suction ends, thereby securing substantial suction volumes of both the compression chambers as large as possible.

For example, the orbiting scroll and the non-orbiting scroll may be disposed in an inner surface of a sealed casing, and the inner space of the casing may be divided into a low-pressure part or portion that communicates with a refrigerant suction pipe and a high-pressure part or portion that communicates with a refrigerant discharge pipe. A suction end of the orbiting wrap and a suction end of the non-orbiting wrap may communicate with the low-pressure part. This may suppress or prevent suction loss in a low-pressure type scroll compressor, thereby improving indicated efficiency and volumetric efficiency.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing;

a drive motor disposed in an inner space of the casing;

a main frame disposed at one side of the drive motor;

an orbiting scroll having an orbiting wrap formed on one side surface of an orbiting end plate and configured to perform an orbiting motion while supported on the main frame;

a non-orbiting scroll having a non-orbiting wrap formed on one side surface of a non-orbiting end plate portion facing the orbiting end plate portion and engaged with the orbiting wrap to form compression chambers;

an Oldham ring disposed between the orbiting scroll and the main frame or between the orbiting scroll and the non-orbiting scroll so that the orbiting scroll performs the orbiting motion, wherein a first sealing portion is defined between an inner surface of the orbiting wrap and an outer surface of the non-orbiting wrap facing the inner surface of the orbiting wrap in a radial direction, and a second sealing portion is defined between an inner surface of the non-orbiting wrap and an outer surface of the orbiting wrap facing the inner surface of the non-orbiting wrap in the radial direction, wherein the first sealing portion and the second sealing portion comprise sealing surfaces, respectively, at which the wraps facing each other are in surface-contact, wherein the inner space of the casing is divided into a low-pressure portion that communicates with a refrigerant suction pipe and a high-pressure portion that communicates with a refrigerant discharge pipe, and a suction end of the orbiting wrap and a suction end of the non-orbiting wrap communicate with the low-pressure portion, wherein the sealing surface disposed on the inner surface of the orbiting wrap extends from the suction end of the orbiting wrap, and wherein the sealing surface disposed on the inner surface of the non-orbiting wrap extends from the suction end of the non-orbiting wrap; and wherein the sealing surfaces are formed such that each of the sealing surfaces located on the inner surface of the orbiting wrap and the inner surface of the non-orbiting wrap has a radius of curvature larger than or equal to a radius of curvature of each of the sealing surfaces located on the outer surface of the non-orbiting wrap and the outer surface of the orbiting wrap.

2. The scroll compressor of claim 1, wherein the sealing surfaces are configured such that surfaces in surface-contact are engaged with each other.

3. The scroll compressor of claim 1, wherein the sealing surfaces are formed such that surfaces in surface-contact are curved surfaces configured to be engaged with each other.

4. The scroll compressor of claim 3, wherein the radiuses of curvatures of the sealing surfaces are larger than an orbiting radius of the orbiting scroll.

5. The scroll compressor of claim 1, wherein the sealing surfaces are formed at axial ends of the orbiting wrap and the non-orbiting wrap, respectively.

6. The scroll compressor of claim 5, wherein the sealing surfaces are formed such that surfaces facing each other are formed as curved surfaces configured to be engaged with each other, and wherein the curved surfaces defining the sealing surfaces have a same radius of curvature along an axial direction.

7. The scroll compressor of claim 1, wherein the first sealing portion comprises a first orbiting sealing surface formed on the inner surface of the orbiting wrap, and a second non-orbiting sealing surface disposed on the outer surface of the non-orbiting wrap and configured to be in surface-contact with the first orbiting sealing surface, and wherein the second sealing portion comprises a first non-orbiting sealing surface formed on the inner surface of the non-orbiting wrap, and a second orbiting sealing surface disposed on the outer surface of the orbiting wrap and configured to be in surface-contact with the first non-orbiting sealing surface.

8. The scroll compressor of claim 7, wherein the first orbiting sealing surface is recessed into the inner surface of the orbiting wrap, and the second non-orbiting sealing surface protrudes from the outer surface of the non-orbiting wrap, and wherein the first non-orbiting sealing surface is recessed into the inner surface of the non-orbiting wrap, and the second orbiting sealing surface protrudes from the outer surface of the orbiting wrap.

9. The scroll compressor of claim 8, wherein a radius of curvature of the first orbiting sealing surface is larger than or equal to a radius of curvature of the second non-orbiting sealing surface, and wherein a radius of curvature of the first non-orbiting sealing surface is larger than or equal to a radius of curvature of the second orbiting sealing surface.

10. The scroll compressor of claim 9, wherein the radius of curvature of the second non-orbiting sealing surface and the radius of curvature of the second orbiting sealing surface are larger than an orbiting radius of the orbiting scroll.

11. The scroll compressor of claim 9, wherein a central angle of the first orbiting sealing surface is larger than or equal to a central angle of the second non-orbiting sealing surface, and wherein a central angle of the first non-orbiting sealing surface is larger than or equal to a central angle of the second orbiting sealing surface.

12. The scroll compressor of claim 9, wherein a central angle of the first orbiting sealing surface is smaller than a central angle of the second non-orbiting sealing surface, and a central angle of the first non-orbiting sealing surface is smaller than a central angle of the second orbiting sealing surface.

13. A scroll compressor, comprising:

a casing;

a drive motor disposed in an inner space of the casing;

a main frame disposed at one side of the drive motor;

an orbiting scroll having an orbiting wrap formed on one side surface of an orbiting end plate and configured to perform an orbiting motion while supported on the main frame;

a non-orbiting scroll having a non-orbiting wrap formed on one side surface of a non-orbiting end plate portion facing the orbiting end plate portion and engaged with the orbiting wrap to form compression chambers; and an Oldham ring disposed between the orbiting scroll and the main frame or between the orbiting scroll and the non-orbiting scroll so that the orbiting scroll performs the orbiting motion, wherein a first sealing portion is defined between an inner surface of the orbiting wrap and an outer surface of the non-orbiting wrap facing the inner surface of the orbiting wrap in a radial direction, the first sealing portion comprising a protrusion formed on one of the inner surface of the orbiting wrap or the outer surface of the non-orbiting wrap facing the inner surface of the orbiting wrap in the radial direction and a corresponding recess formed on another of the inner surface of the orbiting wrap or the outer surface of the non-orbiting wrap facing the inner surface of the orbiting wrap in the radial direction, and a second sealing portion is defined between an inner surface of the non-orbiting wrap and an outer surface of the orbiting wrap facing the inner surface of the non-orbiting wrap in the radial direction, the second sealing portion comprising a protrusion formed on one of the inner surface of the non-orbiting wrap or the outer surface of the orbiting wrap facing the inner surface of the non-orbiting wrap in the radial direction and a corresponding recess formed on another of the inner surface of the non-orbiting wrap or the outer surface of the orbiting wrap facing the inner surface of the non-orbiting wrap in the radial direction, and wherein radiuses of curvatures of the sealing surfaces are larger than an orbiting radius of the orbiting scroll.

14. The scroll compressor of claim 13, wherein surfaces of the protrusions and recesses are in surface-contact with each other.

15. The scroll compressor of claim 13, wherein the orbiting scroll and the non-orbiting scroll are disposed in an inner space of a sealed casing, wherein the inner space of the casing is divided into a low-pressure portion that communicates with a refrigerant suction pipe and a high-pressure portion that communicates with a refrigerant discharge pipe, and wherein the suction end of the orbiting wrap and the suction end of the non-orbiting wrap communicate with the low-pressure portion.

16. A scroll compressor, comprising:

a casing;

a drive motor disposed in an inner space of the casing;

a main frame disposed at one side of the drive motor:

an orbiting scroll having an orbiting wrap formed on one side surface of an orbiting end plate and configured to perform an orbiting motion while supported on the main frame;

a non-orbiting scroll having a non-orbiting wrap formed on one side surface of a non-orbiting end plate portion facing the orbiting end plate portion and engaged with the orbiting wrap to form compression chambers;

an Oldham ring disposed between the orbiting scroll and the main frame or between the orbiting scroll and the non-orbiting scroll so that the orbiting scroll performs the orbiting motion, wherein the orbiting scroll and the non-orbiting scroll are disposed in an inner space of the casing, wherein the inner space of the casing is divided into a low-pressure portion that communicates with a refrigerant suction pipe and a high-pressure portion that communicates with a refrigerant discharge pipe, wherein a suction end of the orbiting wrap and a suction end of the non-orbiting wrap communicate with the low-pressure portion, wherein a first sealing portion is defined between an inner surface of the orbiting wrap and an outer surface of the non-orbiting wrap facing the inner surface of the orbiting wrap in a radial direction, and a second sealing portion is defined between an inner surface of the non-orbiting wrap and an outer surface of the orbiting wrap facing the inner surface of the non-orbiting wrap in the radial direction, wherein each of the first sealing portion and the second sealing portion comprises sealing surfaces where the wraps facing each other are in surface-contact, wherein the sealing surface disposed on the inner surface of the orbiting wrap extends from an edge where the inner surface of the orbiting wrap and the suction end of the orbiting wrap are connected, and wherein the sealing surface disposed on the inner surface of the non-orbiting wrap extends from an edge where the inner surface of the non-orbiting wrap and the suction end of the non-orbiting wrap are connected;

wherein the sealing surfaces are formed such that each of the sealing surfaces located on the inner surface of the orbiting wrap and the inner surface of the non-orbiting wrap has a radius of curvature larger than or equal to a radius of curvature of each of the sealing surfaces located on the outer surface of the non-orbiting wrap and the outer surface of the orbiting wrap.

* * * * *